US011485604B2

(12) United States Patent
Gehrke et al.

(10) Patent No.: US 11,485,604 B2
(45) Date of Patent: Nov. 1, 2022

(54) DISASSEMBABLE REEL APPARATUS AND METHOD

(71) Applicant: MMG Industries, Inc, Seymour, MO (US)

(72) Inventors: Michael Gehrke, Seymour, MO (US); Robert Street, Seymour, MO (US)

(73) Assignee: MMG INDUSTRIES, INC., Seymour, MO (US)

( * ) Notice: Subject to any disclaimer, the term of this patent is extended or adjusted under 35 U.S.C. 154(b) by 122 days.

(21) Appl. No.: 17/029,827

(22) Filed: Sep. 23, 2020

(65) Prior Publication Data

US 2022/0089404 A1 Mar. 24, 2022

(51) Int. Cl.
*B65H 75/22* (2006.01)
*B65H 75/20* (2006.01)

(52) U.S. Cl.
CPC ..... *B65H 75/22* (2013.01); *B65H 75/20* (2013.01); *B65H 75/2218* (2021.05); *B65H 75/2236* (2021.05); *B65H 75/2245* (2021.05); *B65H 75/2263* (2021.05)

(58) Field of Classification Search
CPC .... B65H 75/20; B65H 75/22; B65H 75/2218; B65H 75/2236; B65H 75/2245; B65H 75/2263
See application file for complete search history.

(56) References Cited

U.S. PATENT DOCUMENTS 3,652,026 A * 3/1972 Awebro ..... B65H 49/38 301/39.1
3,940,085 A 2/1976 Campbell
4,345,724 A 8/1982 Lindell
(Continued)

FOREIGN PATENT DOCUMENTS

CA 2057162 A1 6/1992
CA 2263058 A1 8/2000
(Continued)

OTHER PUBLICATIONS

Machine Translation of FR 2 409 221 A, Jul. 1979. (Year: 1979).*
Machine Translation of DE 41 41 276 A1, Jun. 1993. (Year: 1993).*
https://Irind.com/custom-collapsible-steel-reels-spools-conduit-tubing/.

*Primary Examiner* — William E Dondero
(74) *Attorney, Agent, or Firm* — Klintworth & Rozenblat IP LLP

(57) ABSTRACT

A reel apparatus includes a first plurality of spokes extending between and detachably attached to a first hub and a first ring, a second plurality of spokes extending between and detachably attached to a second hub and a second ring, and a plurality of staves extending between and detachably attached to the first and second plurality of spokes. The first and second rings each comprise at least two detachable segments collectively forming a circumference of the respective first and second rings. The at least two detachable segments each have multiple detachable ends allowing the respective first and second rings to be broken down into the at least two completely detached segments detached at their respective multiple detachable ends. The first and second hubs each comprise opposed detachable portions disposed on opposed sides of the respective first and second plurality of spokes to which they are respectively detachably attached.

25 Claims, 15 Drawing Sheets

(56) References Cited

U.S. PATENT DOCUMENTS

| | | | | |
|---|---|---|---|---|
| 4,462,555 | A | 7/1984 | Olson et al. | |
| 4,620,676 | A | 11/1986 | Missalla | |
| 5,242,129 | A | 9/1993 | Bailey et al. | |
| 3,284,021 | A | 11/1996 | Ryll et al. | |
| 5,575,437 | A | 11/1996 | Campbell | |
| 5,743,486 | A | 4/1998 | Bulman | |
| 5,868,348 | A | 2/1999 | Bulman | |
| 6,199,786 | B1 | 3/2001 | Lessard et al. | |
| 6,527,220 | B2 | 3/2003 | Weaver et al. | |
| 7,364,113 | B2 | 4/2008 | Ripplinger | |
| 7,828,242 | B2 | 11/2010 | Snitselaar | |
| 8,424,796 | B2 | 4/2013 | Witwer et al. | |
| 8,857,753 | B1 | 10/2014 | Calhoun | |
| 9,403,661 | B2 | 8/2016 | Watkins | |
| 9,637,346 | B2 | 5/2017 | Connell | |
| 9,828,209 | B2 | 11/2017 | Temblador et al. | |
| 10,221,036 | B2 | 3/2019 | Temblador et al. | |
| 2004/0178301 | A1 * | 9/2004 | Wampler ..... | B65H 75/146 242/603 |
| 2007/0241226 | A1 | 10/2007 | Manzo | |
| 2020/0198923 | A1 | 6/2020 | Norouzian | |

FOREIGN PATENT DOCUMENTS

| | | | | |
|---|---|---|---|---|
| CA | 2271600 A1 | 8/2000 | | |
| DE | 4141276 A1 * | 6/1993 | ..... | B65H 75/14 |
| FR | 2409221 A * | 7/1979 | ..... | B65H 75/14 |

* cited by examiner

DISASSEMBABLE REEL APPARATUS AND METHOD

FIELD OF THE DISCLOSURE

This disclosure relates to reel apparatus which are disassembable and to methods of assembling them.

BACKGROUND

Existing reel apparatus may be used to reel up, store, and reel out materials in need of efficient storage such as high-density Polyethylene. These reel apparatus may be expensive and timely to manufacture, may require a great deal of space, and may be expensive to transport. When a portion of the reel apparatus is damaged, they may be difficult to repair and the entire reel apparatus often has to be discarded due to the reel apparatus being welded together. Other times, welded portions such as welded flanges or staves may have to be discarded.

A reel apparatus and method of its assembly is needed to overcome one or more of the issues of one or more of the existing reel apparatus.

SUMMARY

In one embodiment, a reel apparatus includes first and second rings, first and second hubs, first and second plurality of spokes, and a plurality of staves. The first plurality of spokes extends between and is detachably attached to the first hub and the first ring. The second plurality of spokes extends between and is detachably attached to the second hub and the second ring. The plurality of staves extends between and is detachably attached to the first and second plurality of spokes. The first and second rings each comprise at least two detachable segments collectively forming a circumference of the respective first and second rings. The at least two detachable segments each have multiple detachable ends allowing the respective first and second rings to be broken down into the at least two completely detached segments detached at their respective multiple detachable ends. The first and second hubs each comprise opposed detachable portions disposed on opposed sides of the respective first and second plurality of spokes to which they are respectively detachably attached.

In another embodiment, a reel apparatus includes first and second rings, first and second hubs, first and second plurality of spokes, and a plurality of staves. The first plurality of spokes extends between and is detachably attached to the first hub and the first ring. The second plurality of spokes extends between and is detachably attached to the second hub and the second ring. The plurality of staves extends between and is detachably attached to the first and second plurality of spokes. A plurality of fasteners connects: (1) for each of the respective first and second hubs, opposed detachable portions to one another; and/or (2) the respective first and second plurality of spokes to the respective first and second hubs; and/or (3) the respective first and second plurality of spokes to the respective first and second rings; and/or (4) for each of the respective first and second rings, at least two completely detachable segments at multiple detachable ends of each of the at least two completely detachable segments to form a circumference of the respective first and second rings.

In still another embodiment, a method of assembling a disassembable reel apparatus is provided. In one step, a first plurality of spokes is removably attached to and between a first hub and a first ring. In another step, a second plurality of spokes is removably attached to and between a second hub and a second ring. In still another step, opposed portions for each of the respective first and second hubs are removably attached to one another, and/or for each of the respective first and second rings, at least two detachable segments are removably attached to one another at multiple detachable ends of each of the at least two detachable segments to form a circumference of the respective first and second rings. In an additional step, a plurality of staves are removably attached to and between the first and second plurality of spokes.

In other embodiments, the reel apparatus and method of assembling the reel apparatus may be varied. The scope of the present disclosure is defined solely by the appended claims and is not affected by the statements within this summary.

BRIEF DESCRIPTION OF THE DRAWINGS

The disclosure can be better understood with reference to the following drawings and description. The components in the figures are not necessarily to scale, emphasis instead being placed upon illustrating the principles of the disclosure.

DETAILED DESCRIPTION

Figure 1:
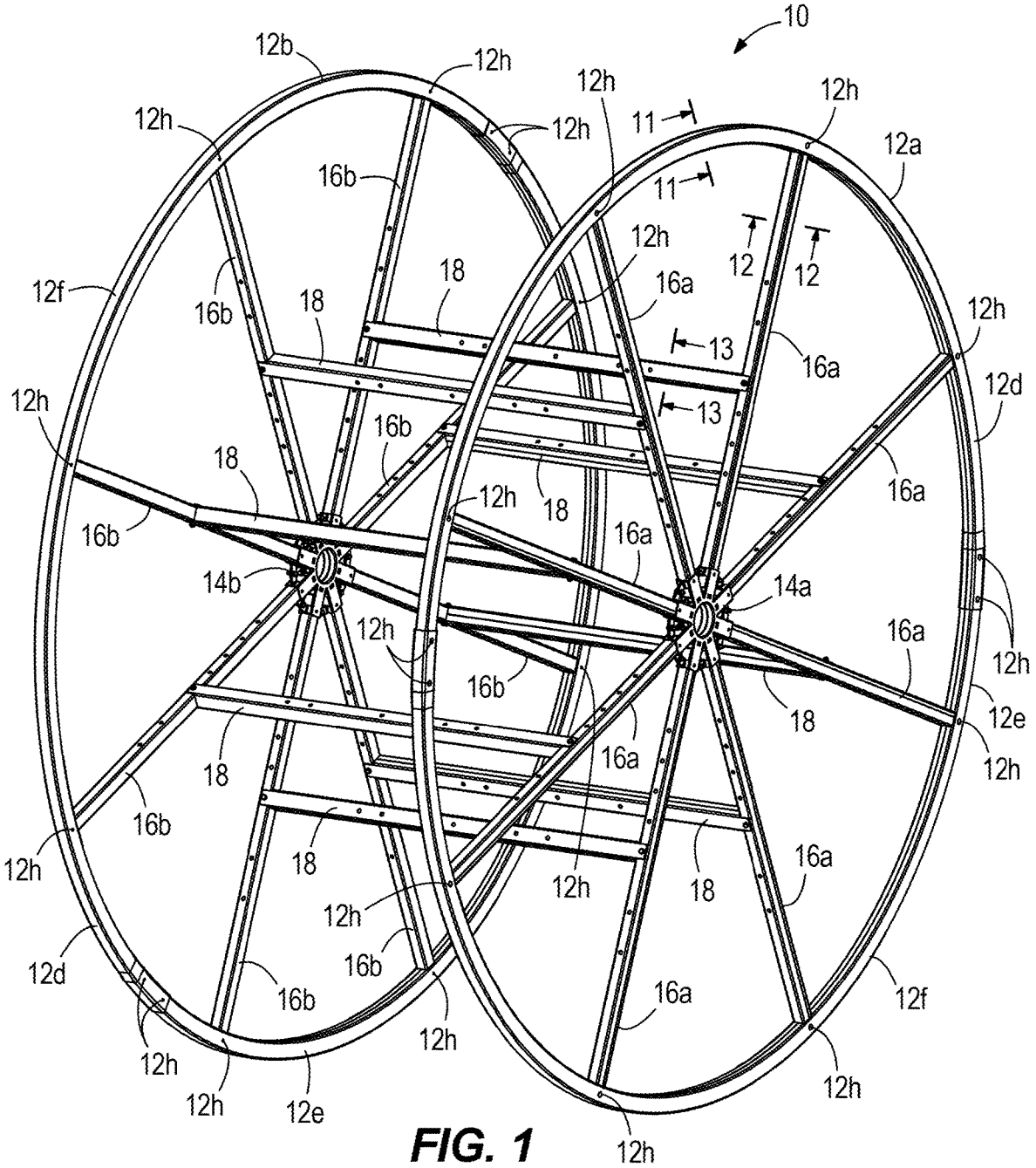
FIG. 1 illustrates a perspective view of one embodiment of a reel apparatus.
Figure 2:
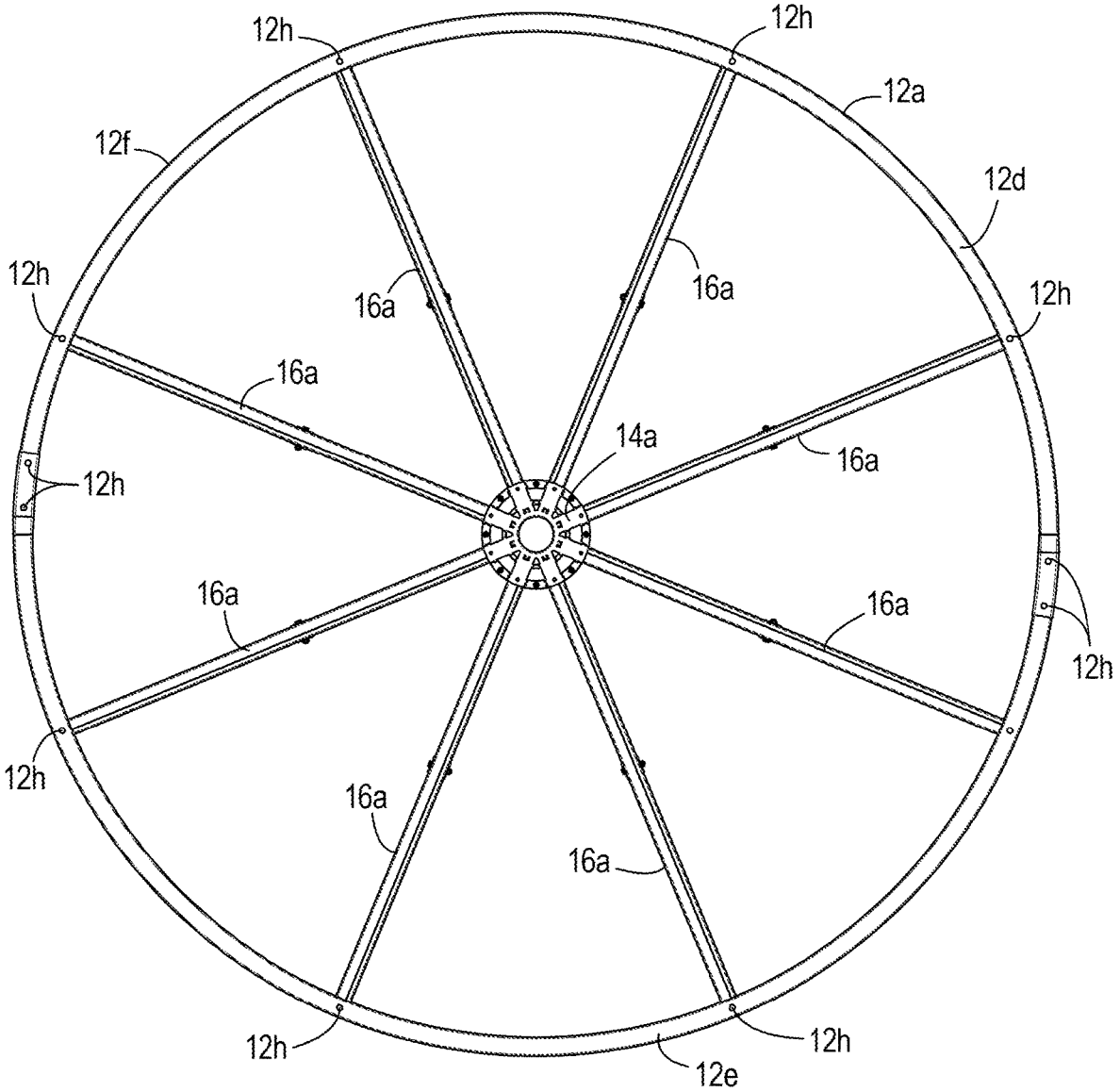
FIG. 2 illustrates a side view of the reel apparatus of FIG. 1.
Figure 3:
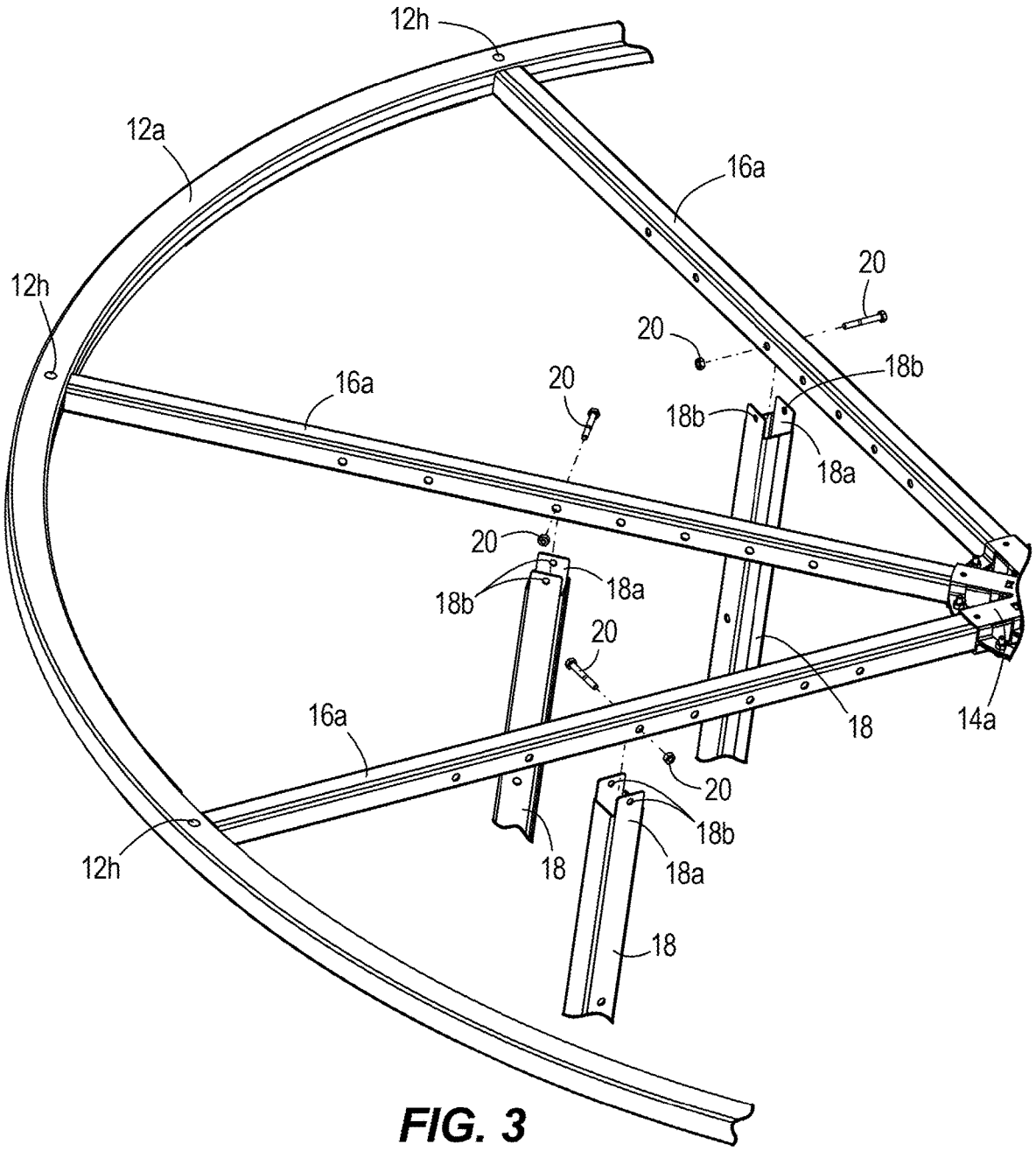
FIG. 3 illustrates a partially disassembled view of a portion of one ring of the reel apparatus of FIG. 1 showing staves detached from spokes of the ring.
Figure 4:
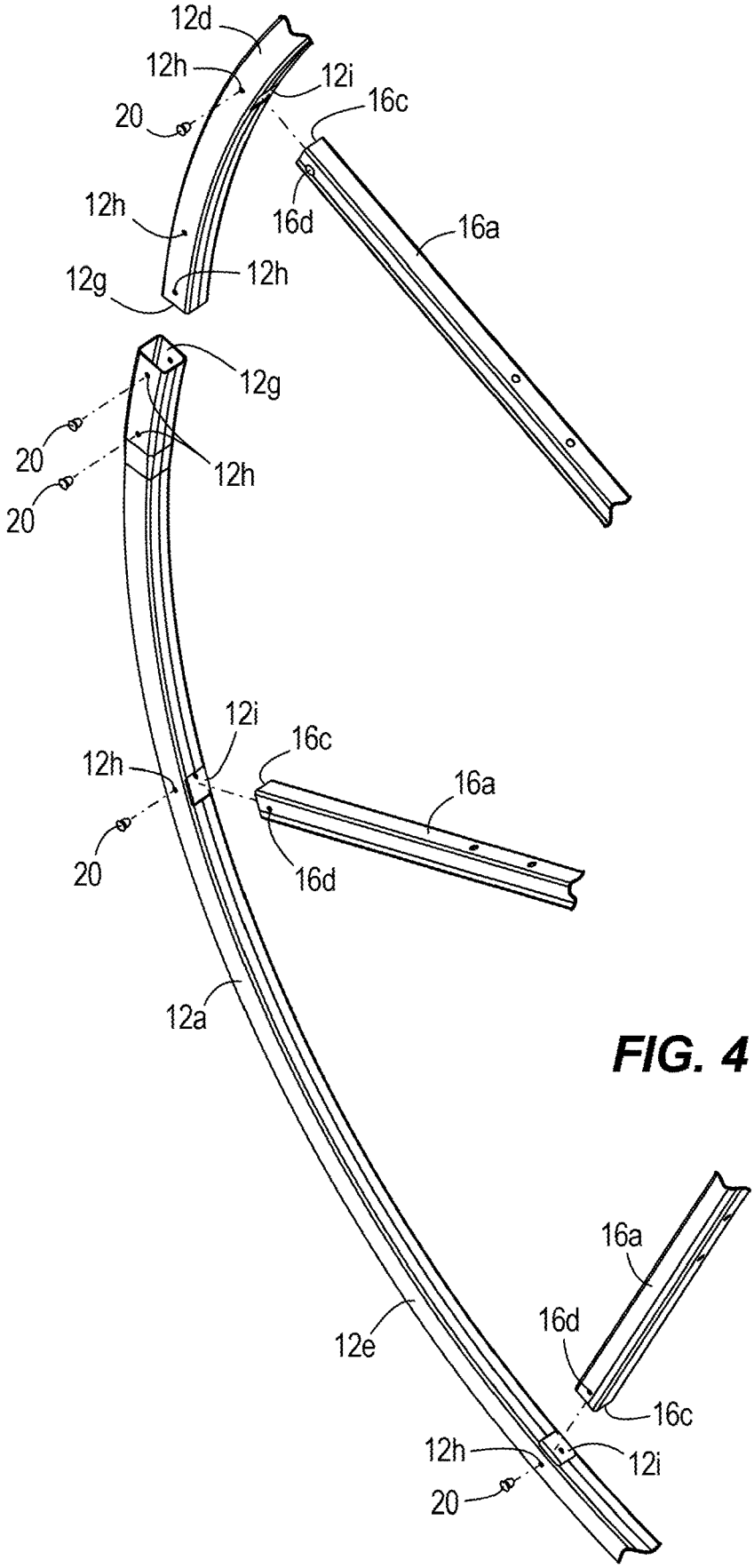
FIG. 4 illustrates a partially disassembled view of a portion of one ring of the reel apparatus of FIG. 1 showing spokes detached from the ring and additionally showing detached segments of the ring.
Figure 5:
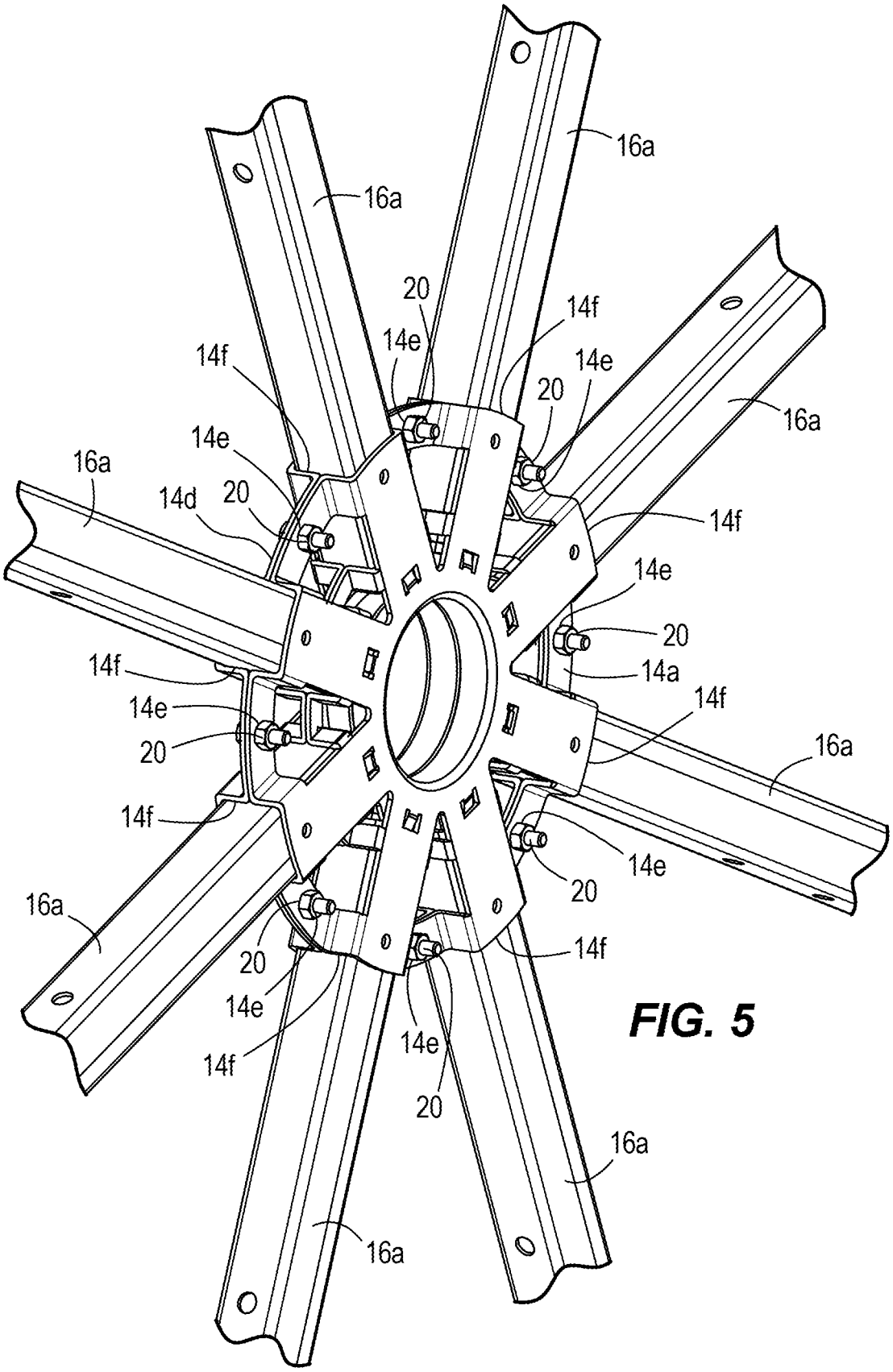
FIG. 5 illustrates a partial view of a hub and connected spokes of the reel apparatus of FIG. 1.
Figure 6:
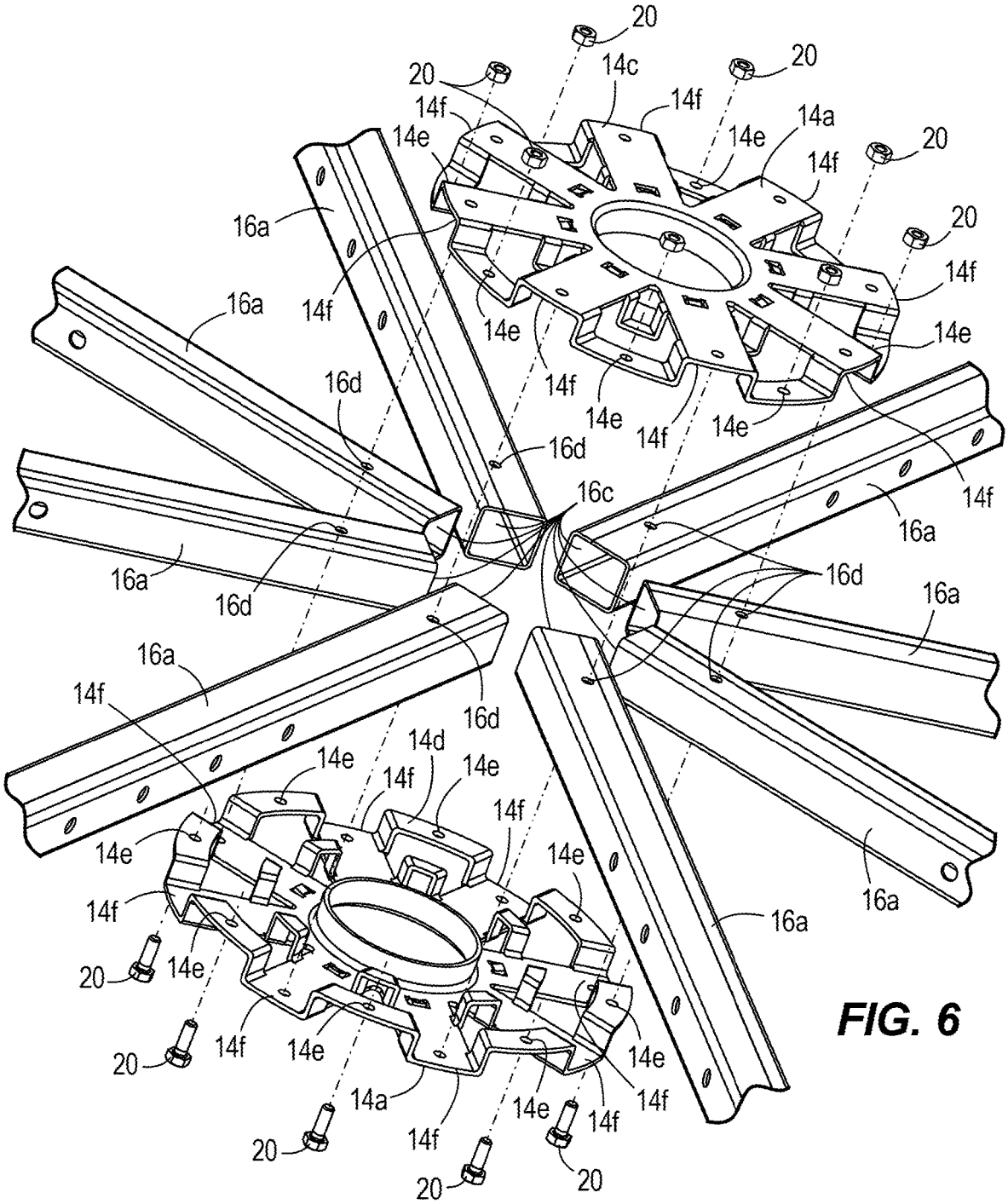
FIG. 6 illustrates a partially disassembled view of the opposed portions of the hub and the spokes of FIG. 5.
Figure 7:
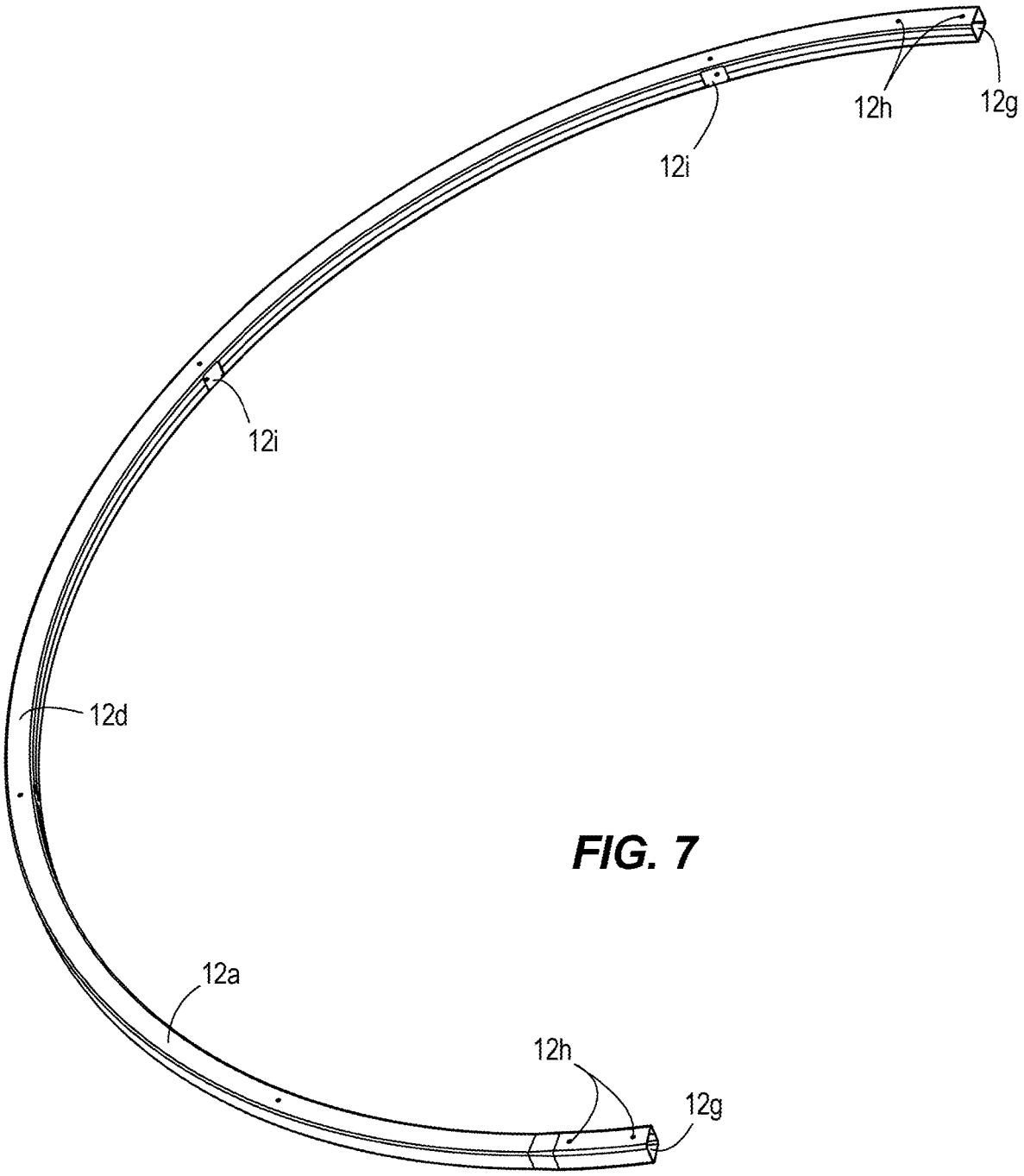
FIG. 7 illustrates a completely detached segment of one of the rings of the reel apparatus of FIG. 1.
Figure 8:
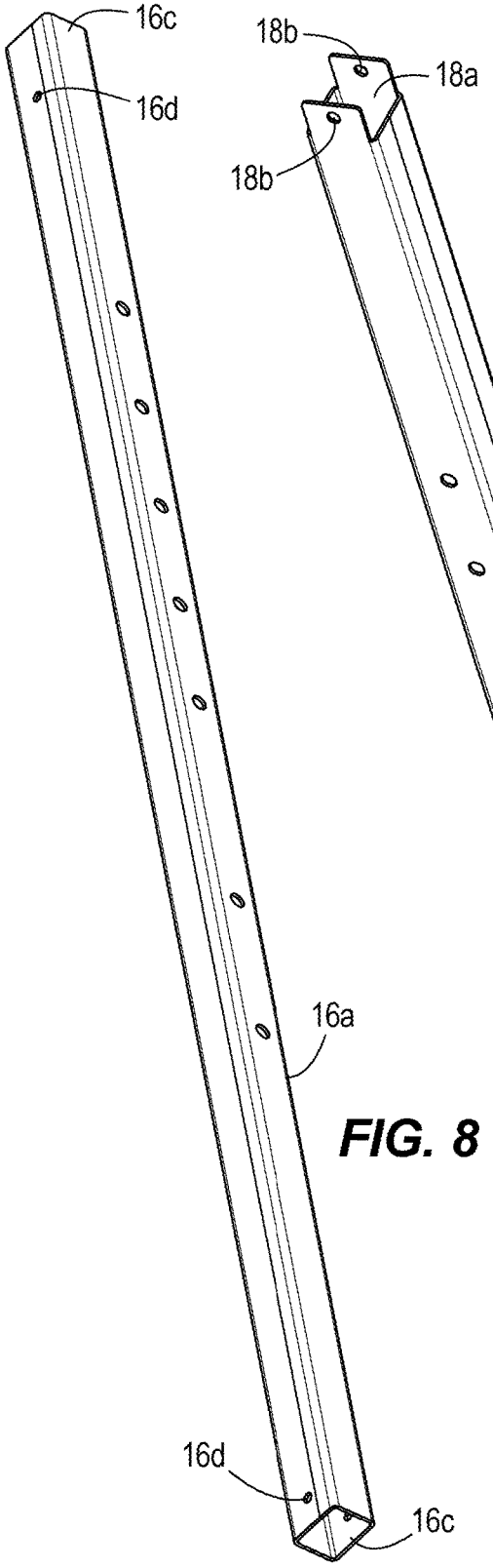
FIG. 8 illustrates a view of one of the spokes of the reel apparatus of FIG. 1 detached from the hub and the ring.
Figure 9:
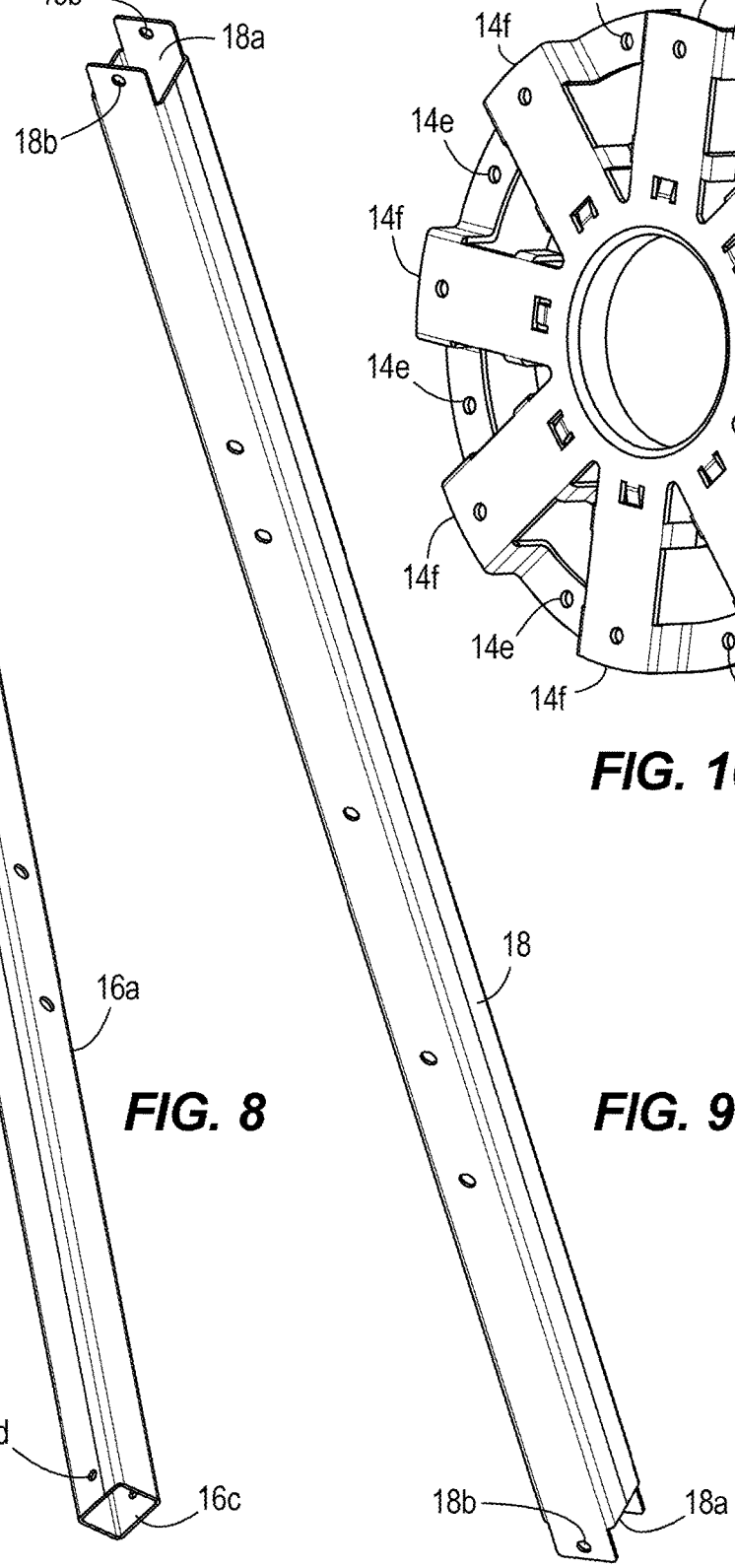
FIG. 9 illustrates a view of one of the staves of the reel apparatus of FIG. 1 detached from the spokes of the rings.
Figure 10:
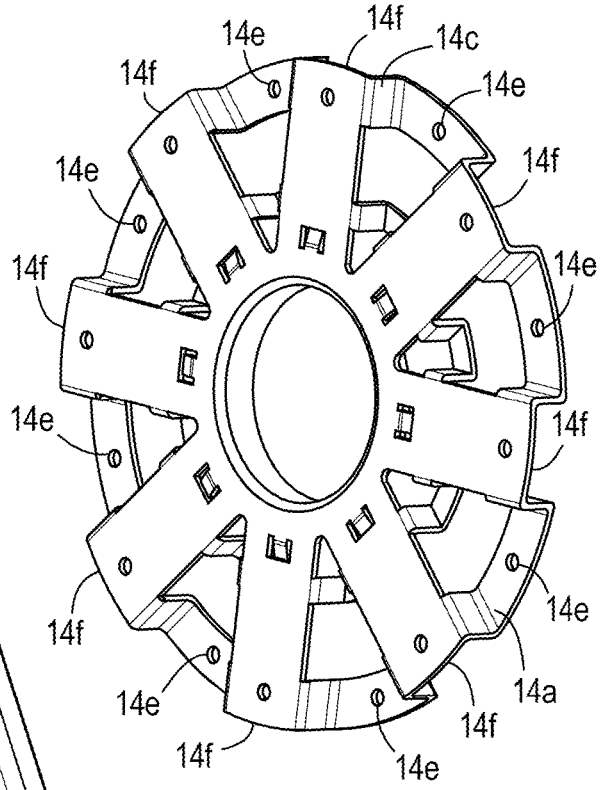
FIG. 10 illustrates a view of one of the opposed portions of the hub of the reel apparatus of FIG. 1.
Figure 11:
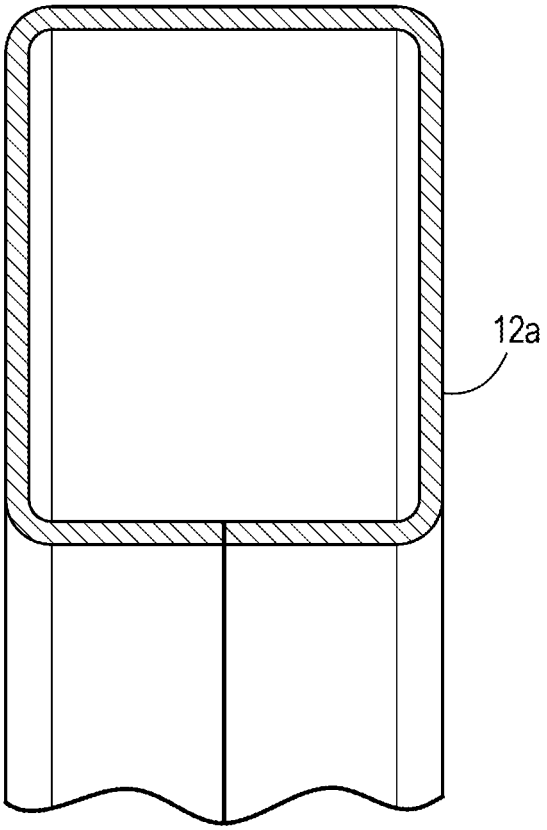
FIG. 11 illustrates a cross-section view along line 11-11 of one of the rings of the reel apparatus of FIG. 1.
Figure 12:
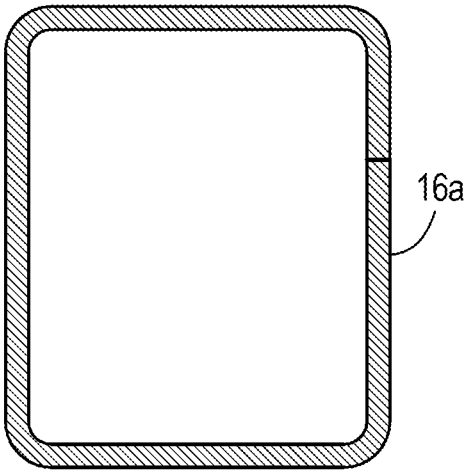
FIG. 12 illustrates a cross-section view along line 12-12 of one of the spokes of the reel apparatus of FIG. 1.
Figure 13:
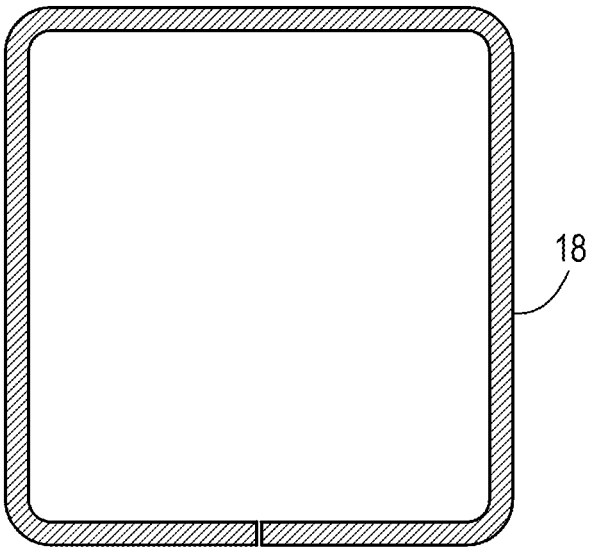
FIG. 13 illustrates a cross-section view along line 13-13 of one of the staves of the reel apparatus of FIG. 1.
Figure 14:
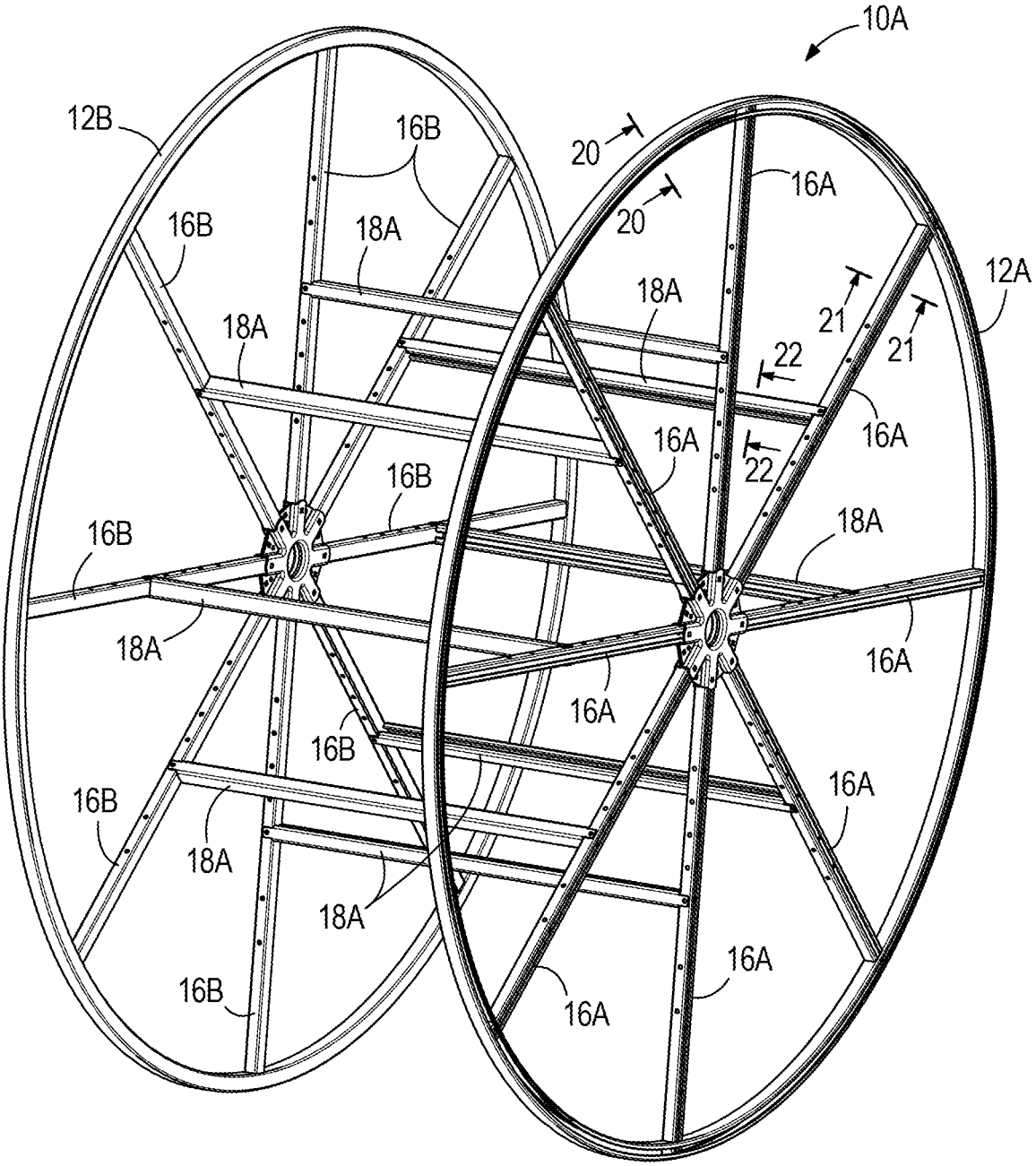
FIG. 14 illustrates a perspective view of another embodiment of a reel apparatus.
Figure 15:
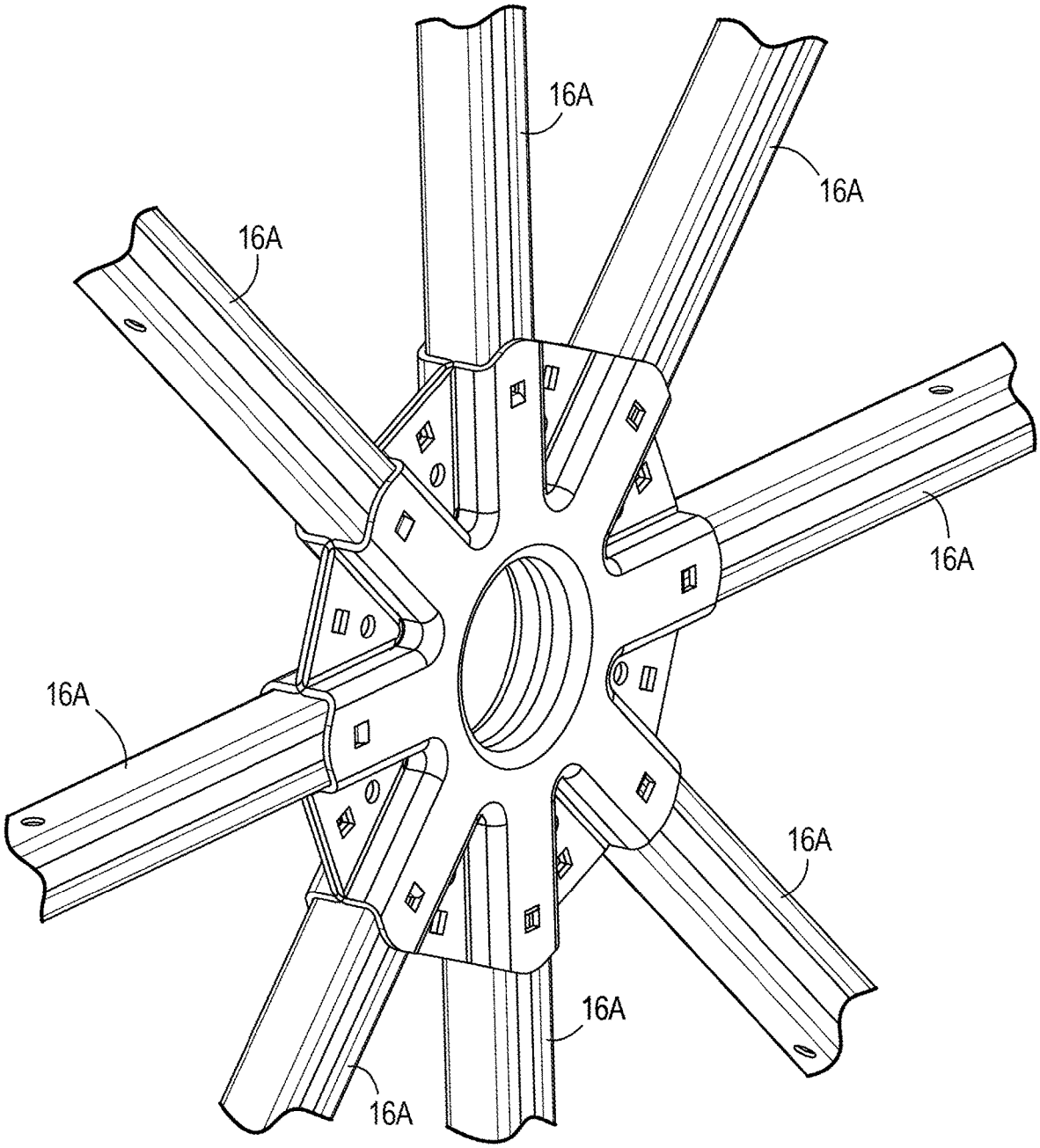
FIG. 15 illustrates a partial view of a hub and connected spokes of the reel apparatus of FIG. 14.
Figure 16:
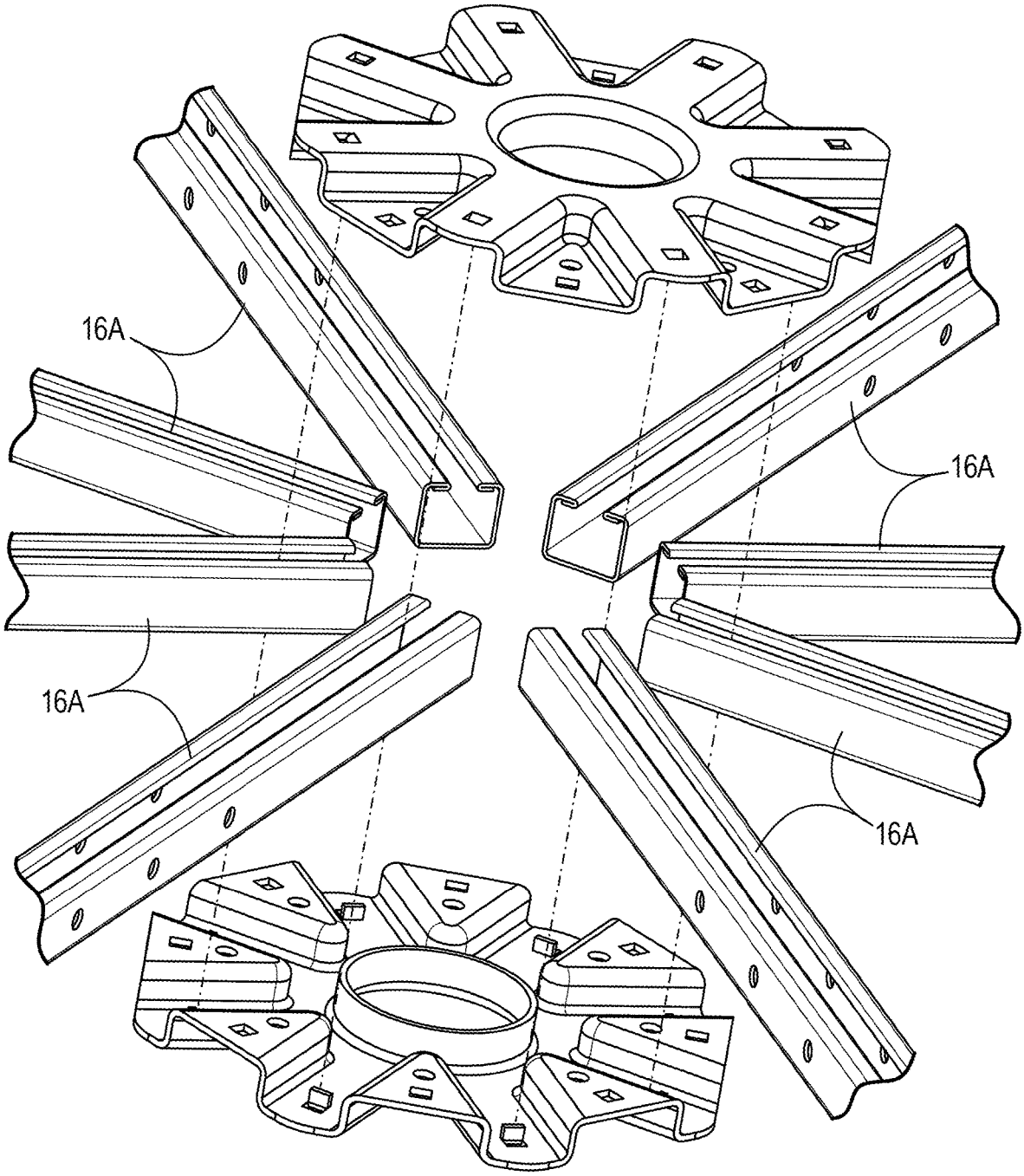
FIG. 16 illustrates a partially disassembled view of the opposed portions of the hub and the spokes of FIG. 15.
Figure 17:
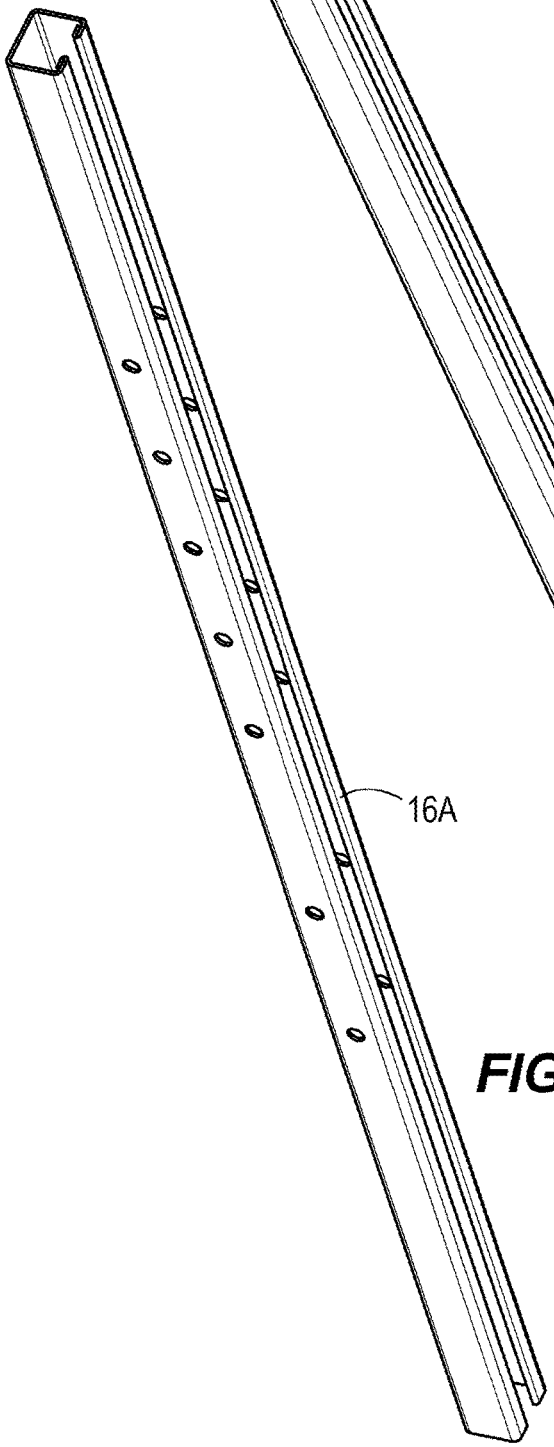
FIG. 17 illustrates a view of one of the spokes of the reel apparatus of FIG. 14 detached from the hub and the ring.
Figure 18:
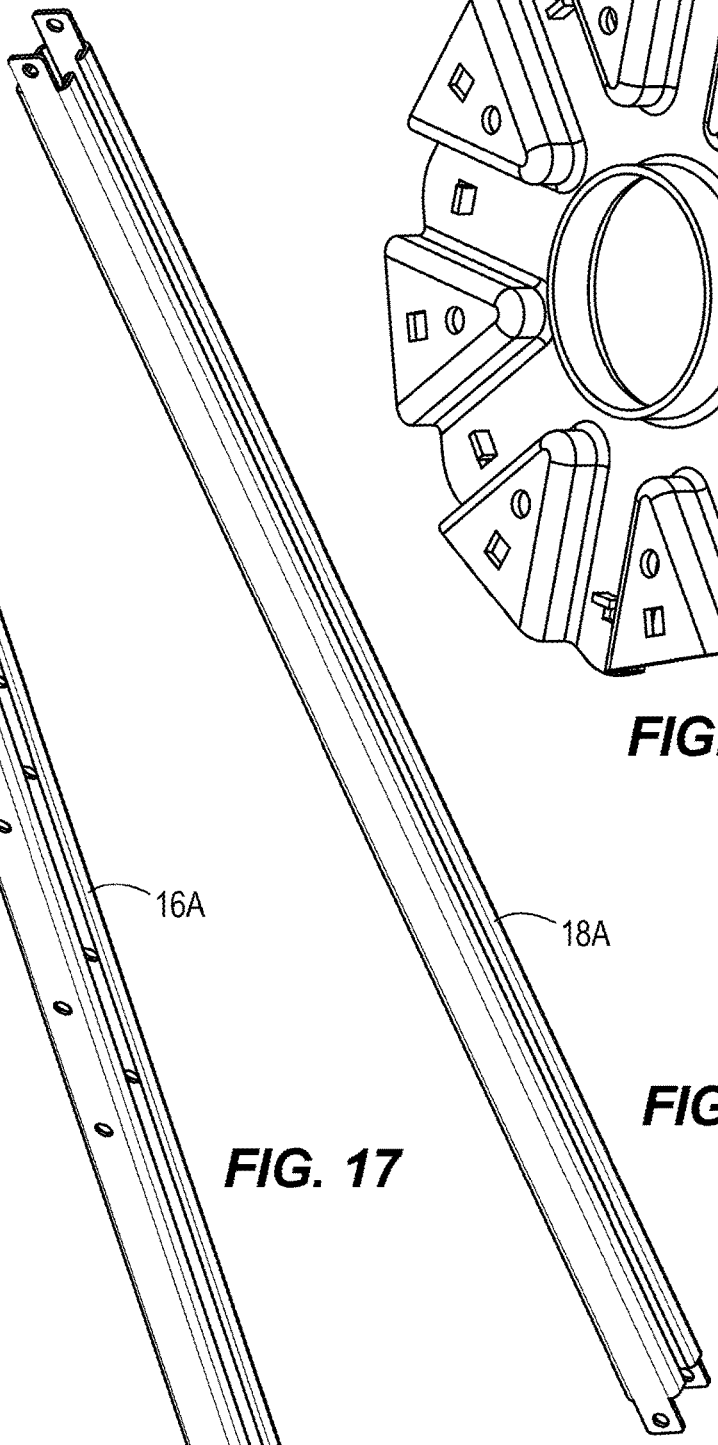
FIG. 18 illustrates a view of one of the staves of the reel apparatus of FIG. 14 detached from the spokes of the rings.
Figure 19:
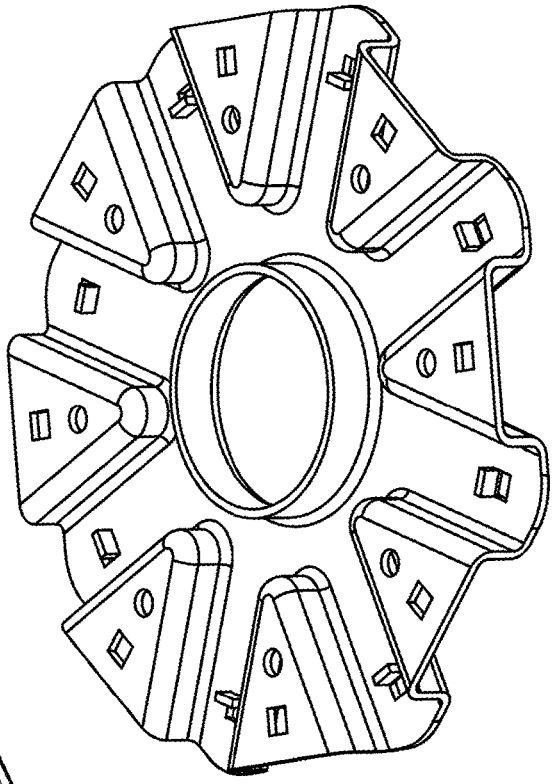
FIG. 19 illustrates a view of one of the opposed portions of the hub of the reel apparatus of FIG. 14.
Figure 20:
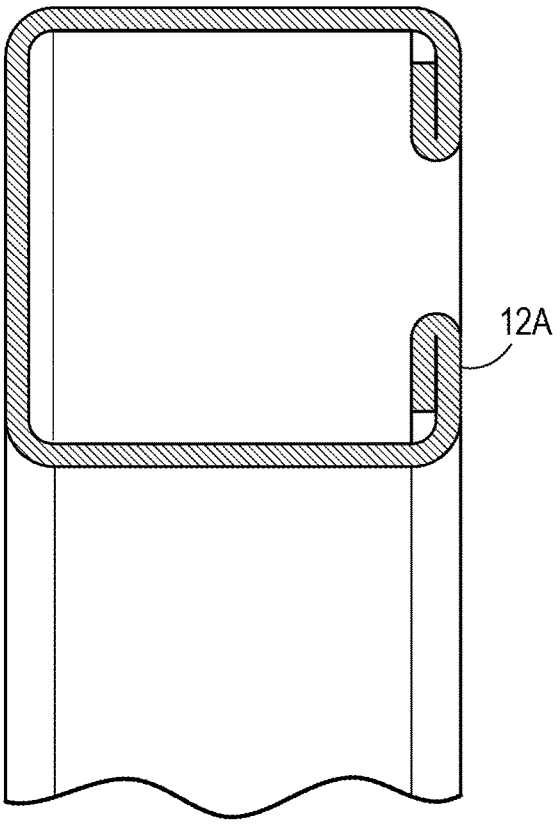
FIG. 20 illustrates a cross-section view along line 20-20 of one of the rings of the reel apparatus of FIG. 14.
Figure 21:
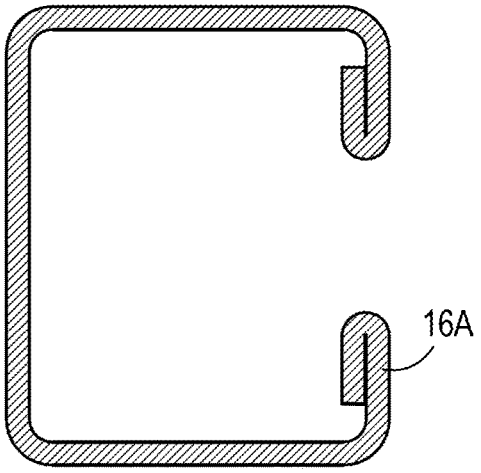
FIG. 21 illustrates a cross-section view along line 21-21 of one of the spokes of the reel apparatus of FIG. 14.
Figure 22:
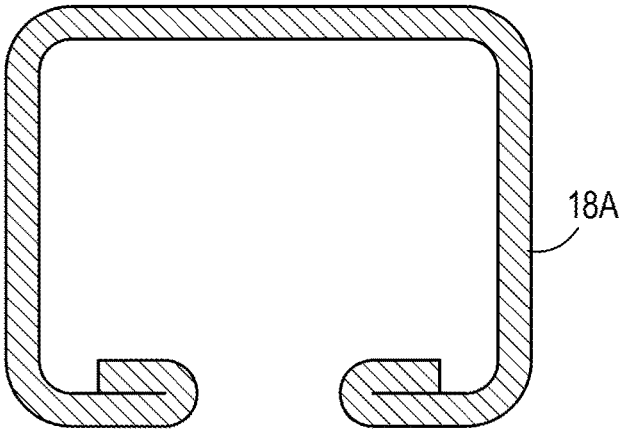
FIG. 22 illustrates a cross-section view along line 22-22 of one of the staves of the reel apparatus of FIG. 14.

The disclosure relates to disassembable reel apparatus which may be used in the high-density Polyethylene (HDPE) market. The reel apparatus may be used in the extrusion process to coil up the finished tubing for storage, transport and installation at the project job site. The entire reel apparatus may be quickly and easily completely disassembled saving time, and reducing manufacture, transport, and repair cost. The components of the reel apparatus may be roll formed, direct roll formed, or stamped. In other embodiments, the components of the reel apparatus may be manufactured using varying methods. Laser welding, electric resistance welding, tungsten inert gas welding, metal inert gas welding, or other welding processes of some of the components of the reel apparatus may be used to increase torsional strength. In other embodiments, varying manufacturing methods may be used to increase torsional strength of one or more components of the reel apparatus. The reel apparatus can be custom designed to increase the weight to strength ratio and material usage. No welding may be necessary to assemble the components of the reel apparatus. No standard square or rectangle tubing may be required to manufacture the reel apparatus. The hubs of the reel apparatus may be shaped to match the spoke configuration of the reel apparatus and may be separable. The components of the reel apparatus may be mechanically fastened, using fasteners such as rivets, bolts, or other types of fasteners such as connectors, clips, or snaps and each of the components may be replaced individually. The shapes of the components of the reel apparatus may be custom made depending on the application of the reel apparatus rather than just reprocessing standard steel tubing. The mounting holes of the components of the reel apparatus may be integrated into blanks before bending the components. The reel apparatus may be completely assembled at the customer's facility saving shipping and labor costs. In some embodiments, the staves, spokes, hubs, or other components of the reel apparatus may be designed to snap in place, similar to a shelf or pallet racking. The rings of the reel apparatus may be segmented to allow the use of standard semi-trucks to help with freight costs. The reel apparatus may be rebuildable, easy to ship, easy to repair, and environmentally friendly. The reel apparatus may additionally have further benefits over existing reel apparatus.

FIGS. 1-13 collectively show one embodiment of a reel apparatus 10 which may be used to wind and unwind tubing to and from the reel apparatus 10. The reel apparatus 10 comprises in part first and second rings 12*a* and 12*b*, first and second hubs 14*a* and 14*b*, a first and second plurality of spokes 16*a* and 16*b*, a plurality of staves 18, and a plurality of fasteners 20. In other embodiments, the reel apparatus 10 may comprise any number of connected rings, hubs, spokes, staves, and fasteners to form any number of divided/compartmentalized/connected reels that can be used to wind and unwind different types of tubing in each divided/compartmentalized reel of the reel apparatus 10.

The first and second hubs 14*a* and 14*b* each comprise opposed detachable portions 14*c* and 14*d* disposed on opposed sides of the respective first and second plurality of spokes 16*a* and 16*b* to which they are respectively detachably attached. The opposed detachable portions 14*c* and 14*d* of the respective first and second hubs 14*a* and 14*b* are connected to one another using the plurality of fasteners 20. The fasteners 20 may comprise screws, bolts, rivets, nuts, or other types of fasteners such as connectors, snaps, or clips. The plurality of fasteners 20 may extend through holes 14*e* in each of the respective opposed detachable portions 14*c* and 14*d* to removably attach the opposed detachable portions 14*c* and 14*d* together. The opposed detachable portions 14*c* and 14*d* of the first and second hubs 14*a* and 14*b* when attached together may form respective openings 14*f* in each of the opposed detachable portions 14*c* and 14*d*. In other embodiments, the first and second hubs 14*a* and 14*b* may vary. For instance, in other embodiments the first and second hubs 14*a* and 14*b* may each comprise only one integral, non-separable component.

Cross-sections of the first and second rings 12*a* and 12*b* may each comprise a welded closed rectangular shape for torsional strength. In other embodiments, the cross-sections of the first and second rings 12*a* and 12*b* may be in varying shapes and may be open or closed depending on the torsional strength required for the application. The first and second rings 12*a* and 12*b* may each comprise at least two detachable segments 12*d* and 12*e* collectively forming a circumference 12*f* of the respective first and second rings 12*a* and 12*b*. The at least two detachable segments 12*d* and 12*e* may each have multiple detachable ends 12*g* allowing the respective first and second rings 12*a* and 12*b* to be broken down into the at least two completely detached segments 12*d* and 12*e* detached at their respective multiple detachable ends 12*g*. The at least two completely detachable segments 12*d* and 12*e* of each of the first and second rings 12*a* and 12*b* may comprise semi-circular shapes. In other embodiments, any number of completely detachable segments may be utilized comprising varying portions of a circular shape. The plurality of fasteners 20 may connect, for each of the first and second rings 12*a* and 12*b*, the at least two completely detachable segments 12*d* and 12*e*. The fasteners 20 may comprise screws, bolts, rivets, nuts, or other types of fasteners such as connectors, snaps, or clips. The plurality of fasteners 20 may extend through aligned holes 12*h* in the respective multiple detachable ends 12*g* of each of the at least two completely detachable segments 12*d* and 12*e* in order to removably attach the at least two completely detachable segments 12*d* and 12*e* together. In other embodiments, the first and second rings 12*a* and 12*b* may vary. For instance, in other embodiments the first and second rings 12*a* and 12*b* may each comprise only one integral, non-separable component.

Cross-sections of the first and second plurality of spokes 16*a* and 16*b* may each comprise a welded closed rectangular shape for torsional strength. In other embodiments, the cross-sections of the first and second plurality of spokes 16*a* and 16*b* may be in varying shapes and may be open or closed depending on the torsional strength required for the application. The first plurality of spokes 16*a* may extend between and be detachably attached to the first hub 14*a* and the first ring 12*a*. Similarly, the second plurality of spokes 16*b* may extend between and be detachably attached to the second hub 14*b* and the second ring 12*b*. Opposed ends 16*c* of each of the first plurality of spokes 16*a* may extend into the respective openings 14*f* of the first hub 14*a* and respective apertures 12*i* of the first ring 12*a*. Opposed ends 16*c* of each of the second plurality of spokes 16*b* may extend into the respective openings 14*f* of the second hub 14*b* and respective apertures 12*i* of the second ring 12*b*. The plurality of fasteners 20 may connect the opposed ends 16*c* of each of the first plurality of spokes 16*a* to the first hub 14*a* and the first ring 12*a*, and may connect the opposed ends 16*c* of each of the second plurality of spokes 16*b* to the second hub 14*b* and the second ring 12*b*. The fasteners 20 may comprise screws, bolts, rivets, nuts, or other types of fasteners such as connectors, snaps, or clips. Optionally, the plurality of fasteners 20 may extend through holes 14*e* in each of the respective opposed detachable portions 14*c* and 14*d* of the first hub 14*a* and through holes 16*d* in one of the opposed ends 16*c* of each of the first plurality of spokes 16*a*. The plurality of fasteners 20 may also extend through holes 12*h* in the at least two completely detachable segments 12*d* and 12*e* of the first ring 12*a* and through holes 16*d* in another of the opposed ends 16*c* of each of the first plurality of spokes 16*a*.

Similarly, optionally the plurality of fasteners 20 may extend through holes 14*e* in each of the respective opposed detachable portions 14*c* and 14*d* of the second hub 14*b* and through holes 16*d* in one of the opposed ends 16*c* of each of the second plurality of spokes 16*b*. The plurality of fasteners 20 may also extend through holes 12*h* in the at least two completely detachable segments 12*d* and 12*e* of the second ring 12*b* and through holes 16*d* in another of the opposed ends 16*c* of each of the second plurality of spokes 16*b*.

In other embodiments, the first plurality of spokes 16*a* may be attached to and between the first hub 14*a* and the first ring 12*a* utilizing varying types of fasteners such as rivets, bolts, or other types of fasteners such as connectors, clips, or snaps in varying locations and configurations. Similarly, in other embodiments, the second plurality of spokes 16*b* may be attached to and between the second hub 14*b* and the second ring 12*b* utilizing varying types of fasteners such as rivets, bolts, or other types of fasteners such as connectors, clips, or snaps in varying locations and configurations.

Cross-sections of the plurality of staves 18 may each comprise a welded or lock-seam closed rectangular shape for torsional strength. In other embodiments, the cross-sections of the plurality of staves 18 may be manufactured in varying ways, may be in varying shapes, and may be open or closed depending on the torsional strength required for the application. The plurality of staves 18 extend between and are detachably attached to the first and second plurality of spokes 16*a* and 16*b*. Opposed ends 18*a* of each of the plurality of staves 18 may be disposed in open-shapes such as U-shapes. The plurality of staves 18, including their opposed ends 18*a*, may each be one integrally formed part. In other embodiments, the plurality of staves 18 may each comprise a varying number of parts. The plurality of fasteners 20 connect the opposed ends 18*a* of each of the plurality of staves 18 to the respective first and second plurality of spokes 16*a* and 16*b*. The open-shaped opposed ends 18*a* of the plurality of staves may snap in place to the respective first and second plurality of spokes 16*a* and 16*b* so that the respective first and second plurality of spokes 16*a* and 16*b* are disposed within the respective open-shaped opposed ends 18*a*. The fasteners 20 may comprise screws, bolts, rivets, nuts, or other types of fasteners such as connectors, snaps, or clips. The plurality of fasteners 20 may extend through holes 18*b* in the respective open-shaped opposed ends 18*a* of the plurality of staves 18 through the respective first and second plurality of spokes 16*a* and 16*b*. In other embodiments, the plurality of staves 18 may be attached to and between the first and second plurality of spokes 16*a* and 16*b* using varying types of fasteners such as rivets, bolts, or other types of fasteners such as connectors, clips, or snaps in varying locations and configurations. In another embodiment, the plurality of staves 18 may be attached to and between the first and second hubs 14*a* and 14*b*.

FIGS. 14-22 collectively show another embodiment of a reel apparatus 10A which may be used to wind and unwind tubing to and from the reel apparatus 10A. The reel apparatus 10A is identical to the reel apparatus 10 of FIGS. 1-13 in all respects except as stated herein. Instead of the reel apparatus 10 of FIGS. 1-13 utilizing first and second rings 12*a* and 12*b* each comprising at least two detachable segments 12*d* and 12*e*, the reel apparatus 10A of FIGS. 14-22 utilizes first and second rings 12A and 12B which are each one-piece and do not comprise detachable segments. The only other difference is that, for the reel apparatus 10A, the cross-sections of the first and second rings 12A and 12B, of the first and second plurality of spokes 16A and 16B, and of the plurality of staves 18A each comprise open rectangular shapes which do not have as much torsional strength as, in the reel apparatus 10, the welded closed rectangular shapes of the cross-sections of the first and second rings 12*a* and 12*b*, of the first and second plurality of spokes 16*a* and 16*b*, and of the plurality of staves 18. In other embodiments, varying disassembable reel apparatus may be utilized having varying components detachably connected in varying configurations, numbers, and using varying attachment fixtures or connectors.

Figure 23:
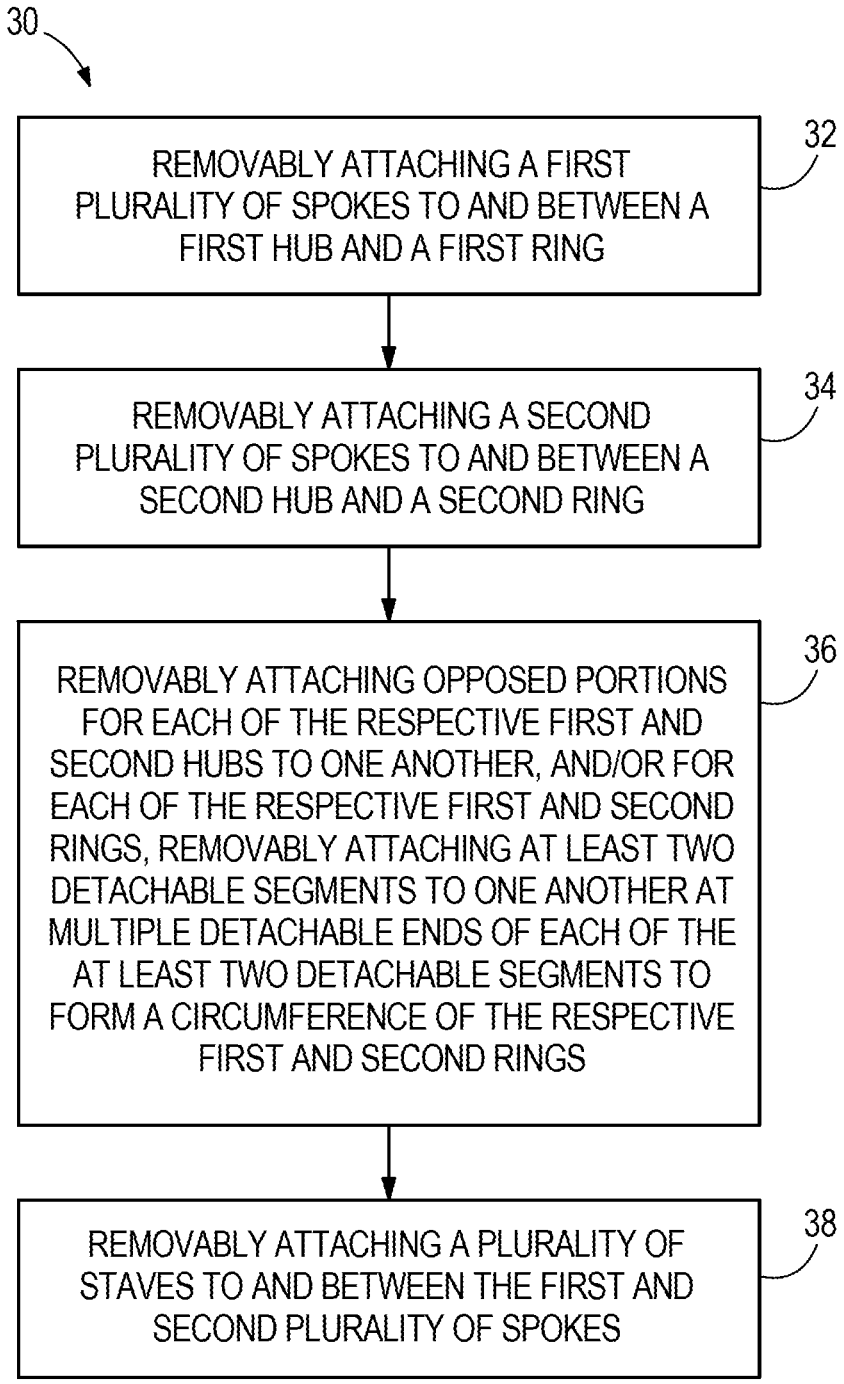
FIG. 23 is a flowchart illustrating one embodiment of a method for assembling a disassembable reel apparatus.

FIG. 23 illustrates one embodiment of a method 30 for assembling a disassembable reel apparatus. The method 30 may utilize any of the reel apparatus disclosed herein. In other embodiments, the method 30 may utilize varying reel apparatus. In step 32, a first plurality of spokes is removably attached to and between a first hub and a first ring. In one embodiment, step 32 further comprises extending the first plurality of spokes into respective openings of the first hub, and connecting the first plurality of spokes to the first hub using fasteners such as rivets, bolts, or other types of fasteners such as connectors, clips, or snaps, and extending the first plurality of spokes into respective apertures of the first ring and connecting the first plurality of spokes to the first ring using fasteners such as rivets, bolts, or other types of fasteners such as connectors, clips, or snaps. In step 34, a second plurality of spokes is removably attached to and between a second hub and a second ring. In one embodiment, step 34 further comprises extending the second plurality of spokes into respective openings of the second hub, and connecting the second plurality of spokes to the second hub using fasteners such as rivets, bolts, or other types of fasteners such as connectors, clips, or snaps, and extending the second plurality of spokes into respective apertures of the second ring and connecting the second plurality of spokes to the second ring using fasteners such as rivets, bolts, or other types of fasteners such as connectors, clips, or snaps.

In step 36, for each of the respective first and second hubs, opposed portions are removably attached to one another, and/or for each of the respective first and second rings, at least two detachable segments are removably attached to one another at multiple detachable ends of each of the at least two detachable segments to form a circumference of the respective first and second rings. In one embodiment, step 36 further comprises using fasteners such as rivets, bolts, or other types of fasteners such as connectors, clips, or snaps to removably attach the opposed portions to one another, and/or using fasteners such as rivets, bolts, or other types of fasteners such as connectors, clips, or snaps to removably attach the at least two detachable segments to one another. In step 38, a plurality of staves is removably attached to and between the first and second plurality of spokes. In one embodiment, step 38 further comprises disposing the respective first and second plurality of spokes into respective open-shaped, such as U-shaped, opposed ends of each of the plurality of staves, and connecting the plurality of staves to and between the first and second plurality of spokes using fasteners such as rivets, bolts, or other types of fasteners such as connectors, clips, or snaps. In other embodiments, one or more steps of the method 30 may be changed in order, not followed, or one or more additional steps may be added.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true scope of the subject matter described herein. Furthermore, it is to be understood that the disclosure is defined by the appended claims. Accordingly, the disclosure is not to be restricted except in light of the appended claims and their equivalents.

The invention claimed is:

1. A reel apparatus comprising:

first and second rings;

first and second hubs;

a first plurality of spokes extending between and detachably attached to the first hub and the first ring;

a second plurality of spokes extending between and detachably attached to the second hub and the second ring;

a plurality of staves extending between and detachably attached to the first and second plurality of spokes; and a plurality of fasteners;

wherein the first and second hubs each comprise opposed detachable portions disposed against one another, and attached using the plurality of fasteners, on opposed sides of the respective first and second plurality of spokes to which they are respectively detachably attached.

2. The reel apparatus of claim 1 wherein the first and second rings each comprise at least two detachable segments collectively forming a respective circumference of the respective first and second rings, the at least two detachable segments each having multiple detachable ends allowing the respective first and second rings to be broken down into the at least two completely detached segments detached at their respective multiple detachable ends.

3. The reel apparatus of claim 2 wherein the at least two detachable segments of each of the first and second rings comprise semi-circular shapes.

4. The reel apparatus of claim 2 wherein the plurality of fasteners attach, for each of the first and second rings, the at least two detachable segments.

5. The reel apparatus of claim 1 wherein opposed ends of each of the first plurality of spokes extend into respective openings of the first hub and respective first apertures formed in a first circumference of the first ring, and opposed ends of each of the second plurality of spokes extend into respective openings of the second hub and respective second apertures formed in a second circumference of the second ring.

6. The reel apparatus of claim 5 wherein the plurality of fasteners attach the opposed ends of each of the first plurality of spokes to the first hub and the first ring, and attach the opposed ends of each of the second plurality of spokes to the second hub and the second ring.

7. The reel apparatus of claim 1 wherein opposed ends of each of the plurality of staves are disposed in open-shapes with the respective first and second plurality of spokes disposed within the open-shapes.

8. The reel apparatus of claim 1 wherein the plurality of fasteners attach opposed ends of each of the plurality of staves to the respective first and second plurality of spokes.

9. A reel apparatus comprising:

first and second rings;

first and second hubs;

a first plurality of spokes extending between and detachably attached to the first hub and to first apertures in a first circumference of the first ring;

a second plurality of spokes extending between and detachably attached to the second hub and to second apertures in a second circumference of the second ring; and a plurality of staves extending between and detachably attached to the first and second plurality of spokes;

wherein opposed detachable portions of each of the respective first and second hubs are attached to and against one another.

10. The reel apparatus of claim 9 further comprising a plurality of fasteners attaching, for each of the respective first and second hubs, the opposed detachable portions to and against one another.

11. The reel apparatus of claim 9 further comprising a plurality of fasteners attaching the respective first and second plurality of spokes to the respective first and second hubs.

12. The reel apparatus of claim 11 wherein the respective first and second plurality of spokes extend into respective openings of the respective first and second hubs.

13. The reel apparatus of claim 9 further comprising a plurality of fasteners attaching the respective first and second plurality of spokes to the respective first and second rings.

14. The reel apparatus of claim 9 further comprising a plurality of fasteners attaching, for each of the respective first and second rings, at least two completely detachable segments at multiple detachable ends of each of the at least two completely detachable segments to form the respective first and second circumference of the respective first and second rings.

15. The reel apparatus of claim 14 wherein the at least two detachable segments of each of the first and second rings comprise semi-circular shapes.

16. The reel apparatus of claim 9 wherein opposed ends of each of the plurality of staves are disposed in open-shapes with the respective first and second plurality of spokes disposed within the open-shapes.

17. The reel apparatus of claim 9 further comprising a plurality of fasteners attaching opposed ends of each of the plurality of staves to the respective first and second plurality of spokes.

18. A method of assembling, using a plurality of fasteners, a disassemblable reel apparatus comprising:

removably attaching a first plurality of spokes to and between a first hub and a first ring;

removably attaching a second plurality of spokes to and between a second hub and a second ring;

removably attaching, for each of the respective first and second hubs, opposed portions of the respective first and second hubs to and against one another using the plurality of fasteners; and removably attaching a plurality of staves to and between the first and second plurality of spokes.

19. The method of claim 18 further comprising extending the first plurality of spokes into respective openings of the first hub, and extending the second plurality of spokes into respective openings of the second hub.

20. The method of claim 18 wherein the removably attaching the first plurality of spokes to and between the first hub and the first ring, and the removably attaching the second plurality of spokes to and between the second hub and the second ring each uses the plurality of fasteners.

21. The method of claim 18 comprising removably attaching, for each of the respective first and second rings, at least two detachable segments to one another at multiple detachable ends of each of the at least two detachable segments to form a respective circumference of the respective first and second rings.

22. The method of claim 21 wherein the removably attaching, for each of the respective first and second rings, the at least two detachable segments to one another at the multiple detachable ends of each of the at least two detachable segments to form the respective circumference of the respective first and second rings comprises using the plurality of fasteners.

23. The method of claim 18 further comprising extending the first plurality of spokes into respective first apertures of a first circumference of the first ring, and extending the second plurality of spokes into respective second apertures of a second circumference of the second ring.

24. The method of claim 18 further comprising disposing the respective first and second plurality of spokes into respective open-shaped opposed ends of each of the plurality of staves.

25. The method of claim 18 wherein the removably attaching the plurality of staves to and between the first and second plurality of spokes comprises using the plurality of fasteners.

* * * * *